United States Patent [19]

Skinn et al.

[11] Patent Number: 4,803,908

[45] Date of Patent: Feb. 14, 1989

[54] AUTOMATIC MUSICAL INSTRUMENT TUNING SYSTEM

[76] Inventors: Neil C. Skinn, 712 Sycamore, Fort Collins, Colo. 80521; Stephen J. Freeland, 2008 Bennington Cir., Fort Collins, Colo. 80526

[21] Appl. No.: 128,685

[22] Filed: Dec. 4, 1987

[51] Int. Cl.[4] ..... G10G 7/02

[52] U.S. Cl. ..... 84/454; 84/DIG. 18

[58] Field of Search ..... 84/454, 477 R, 478, 84/DIG.18, 394, 485 R

[56] References Cited

U.S. PATENT DOCUMENTS

| | | | |
|---|---|---|---|
| 3,144,802 | 8/1964 | Faber, Jr. et al. | 84/454 |
| 4,044,239 | 8/1977 | Shimauchi et al. | 84/DIG. 18 |
| 4,088,052 | 5/1978 | Hedrick | 84/454 |
| 4,196,652 | 4/1980 | Raskin | 84/454 |
| 4,207,791 | 6/1980 | Murakami | 84/454 X |
| 4,313,361 | 2/1982 | Deutsch | 84/454 X |
| 4,327,623 | 5/1982 | Mochida et al. | 84/454 |
| 4,426,907 | 1/1984 | Scholz | 84/454 |
| 4,584,923 | 4/1986 | Minnick | 84/454 |
| 4,732,071 | 3/1988 | Deutsch | 84/454 |

*Primary Examiner*—W. B. Perkey

*Attorney, Agent, or Firm*—Dean P. Edmundson

[57] ABSTRACT

A tuning system is described for automatically tuning a musical instrument having adjustment means for changing the frequency of a musical tone produced by the instrument. The tuning system is useful with respect to a wide variety of musical instruments, e.g., stringed instruments such as guitars, harps, pianoes, etc.; horns; and other instruments. The tuning system is capable of automatically tuning all strings of a stringed instrument simultaneously.

13 Claims, 3 Drawing Sheets

AUTOMATIC MUSICAL INSTRUMENT TUNING SYSTEM

FIELD OF THE INVENTION

This invention relates to tuning of musical instruments. More particularly, this invention relates to techniques for automatically tuning musical instruments. In another aspect, this invention relates to techniques and systems for automatically tuning stringed musical instruments.

BACKGROUND OF THE INVENTION

Tuning of musical instruments is a difficult and tedious yet very necessary procedure for musicians. This is especially true when two or more instruments must be tuned to play at the same time. For example, musicians in an orchestra or a band must have their instruments in tune with each other, and tuned properly, before they can play music together. An even larger complication arises when the musicians or artists attempt to change to and from keys having different base interval relationships.

At times a group of musicians will start playing a song only to realize that one of the group needs to tune his or her instrument. Then a decision must be made to either continue playing out of tune or to stop, tune the instrument, and re-start. If this happens in front of an audience it can be very embarrassing. Of course, there is no guarantee that the state of tune will be any better following re-tuning. Furthermore, the time lost in re-tuning can be irritating to everyone.

Some musical instruments can be tuned in many different ways. For example, the guitar has a dozen different "open tunings", each of which has special advantages for playing certain songs. The performer usually does not want to retune during a performance so he brings to the stage a guitar for each open tuning he will use. Each such guitar must be separately tuned and must be maintained in that condition up to the time it is played. For several different open tunings, this procedure necessitates having several different guitars. This can be quite costly, and it also requires the performer to take the time to change guitars during a performance.

Furthermore, stringed instruments can change enough during a performance to go out of tune. This may be caused by a variety of factors such as humidity, temperature, and continued stress on the strings during playing.

Some musicians are better than others in tuning an instrument. As a result, some musicians are able to tune an instrument correctly in a reasonable period of time, while others (e.g. inexperienced musicians) may require a long period of time to tune and may not be entirely accurate in doing so.

Although there has been previously proposed a tuning apparatus (see, for example, U.S. Pat. No. 4,088,052) to detect the pitch in a stringed instrument electronically, such apparatus is not capable of automatically tuning the instrument. Furthermore, such apparatus can only tune one string at a time. There is also the possibility of error introduced by the mechanical portion of the system. Moreover, the apparatus uses analog filtering which has inherent limitations.

It is also necessary for the string being tuned to be vibrating during the entire tuning process. Another limitation of this apparatus is that it cannot compensate for the effects of neck warpage etc. during tuning of a guitar, for example.

Other types of tuning devices and tuning apparatus are disclosed in the following patents: U.S. Pat. Nos. 4,196,652 (Raskin); 4,207,791 (Murakami); 4,313,361 (Deutsch); 4,327,623 (Mochida); 4,426,907 (Scholz); and 4,584,923 (Minnick).

Each of the prior devices and apparatus exhibit various disadvantages and limitations, however. The primary disadvantage of the prior devices is that they utilize analog filtering of interfering signals to determine the frequencies generated by the instrument. This is not very precise. Furthermore, in an analog system the frequencies must be excited during the entire tuning process.

All of these prior devices are relatively slow in tuning. A device which tunes one string at a time must iterate several times to compensate for non-linear components. Also, none of such devices provide for friction in the nut or bridge. Locations of friction in a guitar or the like are the bridge and/or nut and the tuning peg mechanism. At the bridge or nut a string will move in short spurts due to differences between the coefficients of static and kinetic friction. That is, once a string begins to move it moves further than desired during tuning. The tuning peg mechanism involves considerable friction. Further, none of the prior devices provide compensation for non-linear effects. Non-linear effects include factors such as temperature changes and neck warpage. Nor do any of the prior devices have versatility which enables expansion for interfacing several instruments simultaneously.

For example, several of such devices are only capable of tuning one string at a time. Other devices have inadequate visual readout. Some of the devices are only capable of tuning to equal temperment, and some are only capable of tuning to predetermined frequencies with no variation possible. Also, the possibility of human error still exists with respect to the use of certain devices.

Certain of the devices are capable of tuning a string only when the string is vibrating with enough amplitude to fall into the constraints of the electronic components included in the device. If the amplitude of the signal is not great enough to enable the electronics involved, then the string cannot be tuned at all until the string is re-excited.

Further, certain of the devices use inadequate filtering techniques. Analog filters introduce phase errors into the filtered frequency. When the reference frequency is compared to the filtered frequency errors can occur because there is a phase difference in the two signals.

In yet another respect, some of the devices are mechanically complex and therefore are expensive and prone to unreliability if there is a mechanical failure.

One of the prior devices senses string tension as a means for changing the frequency. This technique has several inherent disadvantages. The number of vibrations per second is inversely proportional to the length of the string and the thickness of the string. It is also proportional to the square root of the tension to which the string is subjected. Finally, the number of vibrations is inversely proportional to the square root of the density of the string. The thickness or cross-sectional area of the string changes in character chiefly due to the stress on the string during playing. Because of the changes in the cross-sectional area the frequency is not in a perfectly linear relation to the tension. Consequently, this method of sensing tension is inferior.

None of the prior tuning devices or apparatus provide the advantages exhibited by the system and techniques of the present invention.

SUMMARY OF THE PRESENT INVENTION

In accordance with the present invention there is provided a system for automatically tuning a musical instrument having adjustment means for changing the frequency of a musical tone produced by the instrument. The system comprises:

(a) a detection means adapted to detect a musical tone produced by said instrument and produce a signal;
(b) converter means adapted to convert said signal to a digital signal;
(c) processing means adapted to convert said digital signal to a frequency signal;
(d) comparator means for comparing said frequency signal to a predetermined frequency value and producing an electrical signal;
(e) motor means activated by said electrical signal; wherein said motor means is operably connected to said adjustment means for adjusting said frequency to correspond with said predetermined value.

The system may also include compensating means for compensating for non-linear effects of the instrument, such as warpage, temperature, and humidity. The compensating means can also compensate for linear effects.

The tuning system of the invention is useful in connection with a wide variety of musical instruments, including stringed and non-stringed instruments. For example, it is useful for tuning guitars, harps, pianos, horns, etc.

The tuning system is capable of automatically tuning all strings of an instrument simultaneously in a rapid and efficient manner. Prior tuning systems have not provided this capability.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Tuning of an instrument such as a stringed instrument involves tightening each string so that it exhibits a particular frequency signal when in motion. The exact frequency which is desired to be produced or generated by each string is dependent upon the type of tuning performed. For example, an instrument can be tuned to a "true" scale or a "tempered" scale. The frequency intervals between each string on each of these different scales are different but are nevertheless related to each other by specific ratios.

When an instrument is not in proper tune, it means that one or more of the strings is not vibrating at the proper or intended frequency. The ratios between the fundamental frequencies on the true scale are supposed to be small whole numbers. Whenever one or more of the strings is out of proper tune the resulting sound of the instrument may be referred to as dissonance. This is very displeasing, especially if the strings are significantly out of tune.

In the automatic tuning system of this invention the frequencies generated by the instrument in a state of open tune, for example, are sampled and determined. Then, using a table or relationship of the correct frequencies for the instrument, an error for each frequency generated by the instrument is determined. The error signal is applied to an electromechanical system which then brings each string to a new state of tuning. For non-stringed instruments the electromechanical system may move a slide, for example, to change the frequency.

The process of sampling the frequencies generated by the instrument may be repeated as often as needed to allow compensating means to compensate for linear and non-linear effects. The compensating means comprises a computer alogorithm which is updated during each samplying regarding any linear or nonlinear behavior of the instrument during tuning. Following complete algorithm updating, any different predetermined state of tuning may be achieved by requesting the electromechanical system to alter the frequencies of the strings. Virtually any parameter which affects the state of tuning of a musical instrument can be included in the computer based state equation for the instrument. As an example, the effect of temperature change during long outdoor performances can be determined and used in the tuning system. The system of the invention can be used not only for open tuning, but also for tempered or true tuning.

The system being described herein may be applied to many musical instruments.

Figure 1:
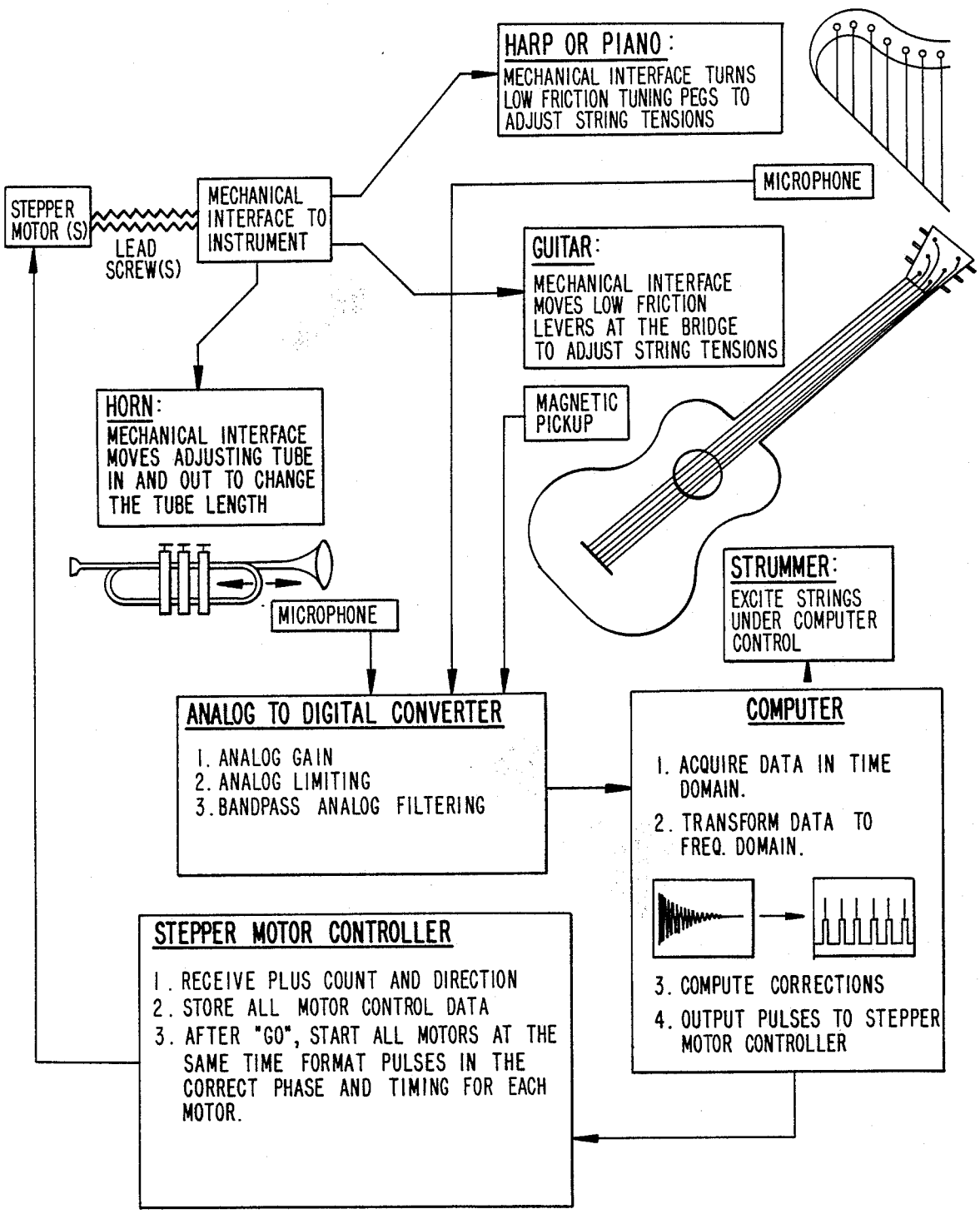
FIG. 1 is a block diagram illustrating the tuning system of the present invention.

FIG. 1 is a schematic diagram illustrating the automatic tuning system of this invention. As one example, the tuning system may be used in connection with a stringed instrument such as a guitar. Once the strings are excited, a transducer such as a magnetic pickup detects musical tones produced by the guitar and produces a corresponding blended signal which is converted to a digital signal by a conventional analog-to-digital converter. Then the digital signal is transferred to a computer which processes the signal using a fast Fourier transform (FFT) to convert the signal to a frequency signal. Then the computer compares the frequency signal to predetermined frequency values and produces corresponding electrical signals. Then each electrical signal activates a motor (e.g., a stepper motor) which is operably connected to adjustment means for adjusting the frequency of the corresponding string to correspond with the predetermined value. The tuning system is capable of tuning all strings of a stringed instrument simultaneously.

As an example of a typical application, the details of a system for guitar will be given where appropriate. The system will automatically adjust the frequency of a vibrating string on a musical instrument by changing the tension of the string using data gathered from a transducer coupled to the instrument. The system can be further adapted to adjust the frequency or frequencies of any musical device where there exists:

(1) a suitable means of transducing those frequencies for computer analysis, and (2) a suitable means of transducing the results of the computer analysis to adjust the frequency or frequencies of the musical device.

Thus, the tuning system of the invention can also be used in connection with other instruments such as a horn, or a harp, or a piano, for example. This is also illustrated in the schematic of FIG. 1. For example, a horn can include a slide mechanism which allows for changing of the frequency of a musical tone produced by the horn. Also, the tuning instrument may be used in connection with a harp or piano.

Various types of detection means may be used to detect the musical tone produced by a musical instrument and produce a corresponding analog signal. For example, any conventional transducer may be used. Thus, there may be used a magnetic pickup for some types of instruments; a microphone; a piezoelectric pickup; optical means; etc. These types of transducers are all useful in certain situations.

The system is described hereinafter with reference to the automatic tuning of a six string electric guitar.

Data Acquisition

The signal from a standard six string magnetic guitar pickup is fed to an analog to digital convertor (ADC). The signal must be amplified and filtered between the magnetic pickup and the ADC with the following general requirements:

(1) the signal must be between half and full scale on the ADC during acquisition, and, (2) frequencies greater than the fundamental frequency of the highest string be effectively attenuated.

Usually this is string #1 tuned to $E_4$ with frequency of 329 Hz. In practical use, the system may be required to adjust string #5 on a 12 string guitar which is $G_4$ at 392 Hz.

Special limiting circuitry may be used if necessary, to provide a signal of the proper amplification. Filtering of 12 to 24 db per octave rolloff starting at a point 10% above the highest string's frequency will be adequate.

Computer Analysis

The data will be acquired starting shortly after all the strings have been set in motion with a "strum". To encompass an acquisition window 10% greater than the highest frequency possible, 392 Hz+39 Hz=431 Hz is required. To define a sinusoidal wave, a minimum of two points per cycle must be acquired (Nyquist sampling theorum). Doubling 431 Hz to 862 points/second gives a data acquisition rate of 1.16 milliseconds/point. An acquisition data array of 1024 points requiring just over 1 second is adequate.

After the data has been acquired, a transformation is performed by the computer shifting the data from the time domain (in which it was acquired) to the frequency domain. In the time domain, the frequency information for each string is hopelessly combined with the frequency information for all the other strings. It is not practical, if even possible, for the computer to extract from the time domain data the information necessary for the decisions required during string adjustment. By transforming the time domain data into the frequency domain, the frequency data for each string emerges from that of the others in such a way that the computer can easily determine the frequency of each string. The tranformation is called the fast Fourier transform (FFT) developed by Cooley and Tukey in 1965. The analysis of the frequency data will require an array of at least 4096 points giving a resolution of at least 431 Hz/4096 points=0.105 Hz/point. To achieve this array size, the 1024 data points acquired may be "zero filled" out to 4096. This adds no new information to the data. The result is that more points define the "peaks" for each string making the frequency determination process more precise.

Figure 2:
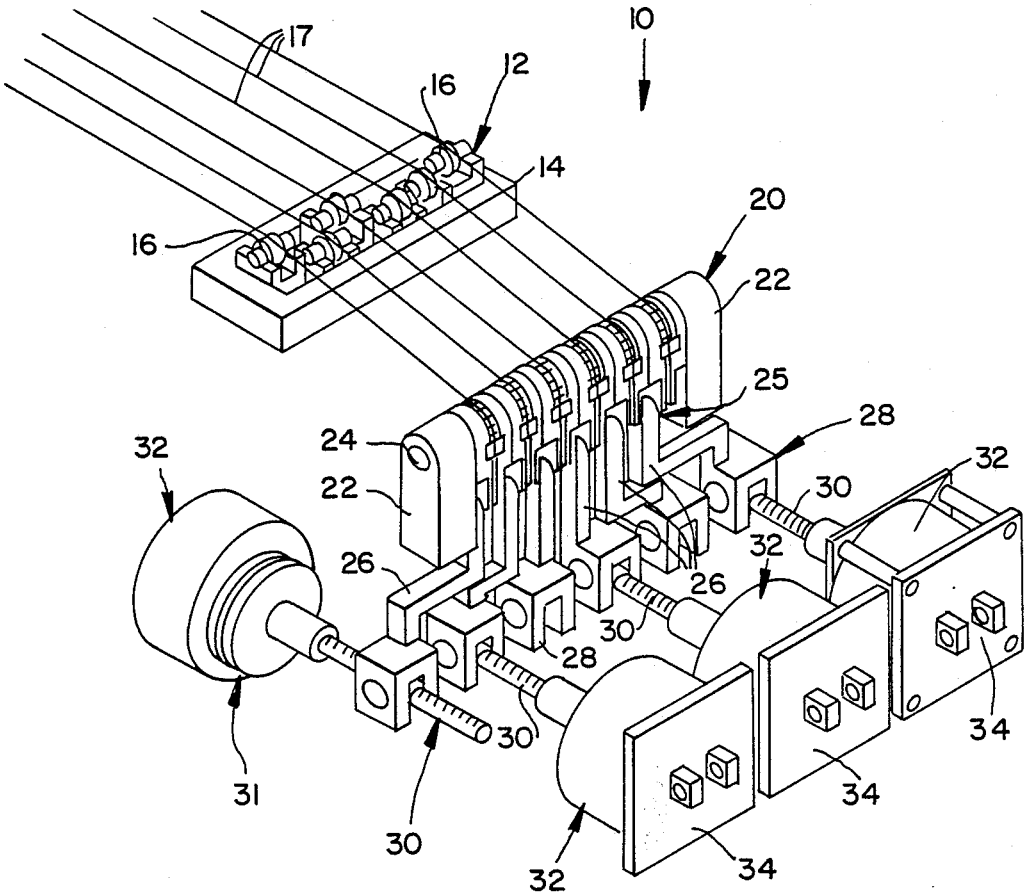
FIG. 2 is an isometric drawing illustrating one embodiment of an automatic tuning assembly of this invention as incorporated into a six-string guitar.
Figure 3:
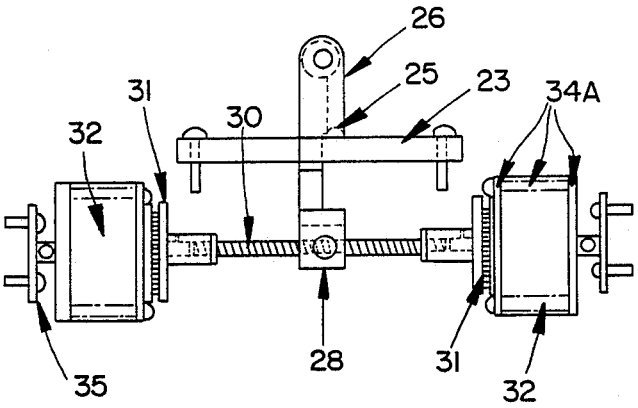
FIG. 3 is a side view of the tuning assembly shown in FIG. 2.
Figure 4:
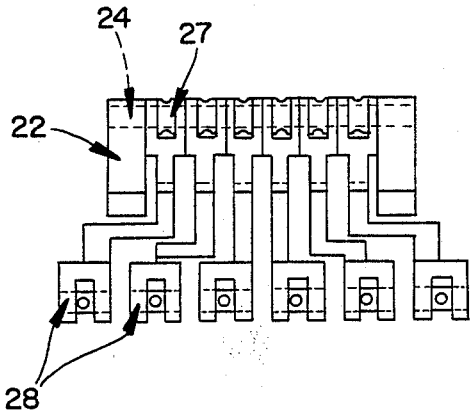
FIG. 4 is a front view of the tune lever assembly shown in FIGS. 2 and 3.

Following the FFT, the computer determines the frequency of each string, compares this value with the currently requested value for that string, and determines the correction, if any, to be applied. The correction is in the form of the numbver of steps and the direction of rotation to be delivered to a stepper motor. The shaft of the stepper motor is connected to the "tuning peg" shaft for the string via a gear or lever reduction system. This is shown in FIGS. 2, 3 and 4.

Thus, there is shown an electromechanical system 10 for incorporation into a guitar for selective adjustment of the length of the separate strings to adjust the frequency thereof. Bridge assembly 12 is secured to the top face of the guitar. This assembly includes base 14 which carries several individual rollers 16. Each roller supports a single string 17 of the guitar at the tail end. The rollers 16 rotate freely so as to impart minimal friction to movement of the strings as they are tightened or loosened.

Tail piece or tune lever assembly 20 is secured in a recessed area in the guitar. Assembly 20 includes king posts 22 and king post bases 23 on each end which support dowel pin 24. Supported on dowel pin 24 are six individual lever arms 26 and free rotating rollers 27.

The upper end of each lever arm 26 is free to pivot on dowel pin 24. The lower end of each lever arm includes a pin joint 28 which is adapted to engage a threaded shaft 30 controlled by a stepper motorl 32. Each stepper motor includes a thrust bearing 31. A mounting assembly 34A, including mounting plate 34, is secured to each stepper motor and serves as a means for mounting each motor to a tilt mount 35 in the recessed area of the guitar in a manner such that the motor can pivot slightly. The end of each string includes an enlarged section (not shown) which is captured in holder 25 on each lever arm 26.

Thus, upon receipt of an electrical signal from the computer, each stepper motor rotates a corresponding shaft 30 in order to pivot a lever arm 26. This causes the corresponding string 17 to be either loosened or tightened, as required, to adjust it to the desired frequency.

Because a general purpose computer system is used in the decision making process, information regarding such things as the interaction among the strings as they are tuned can be included. An example of this is the "neck bowing" caused by the change in tension of the string being tuned. This causes a change in the tension of strings not being tuned resulting in an unwanted change in their frequencies. These kinds of interactions are all well documented in the musical literature to the extend that many have complete equations describing their effects. Utilizing this information, the movement of all the strings to their correct frequencies can be done all at once rather than the more lengthy "trial and error" procedure used previously.

To eliminate detailed consideration of these and other algorithms, the system will "calibrate" the guitar before each playing by allowing the computer system to measure all the effects possible. One could use a small, computer controlled "strummer" allowing the computer to automatically go through a series of tests by setting up the data acquisition, actuating the "strummer", collecting the data, updating its total algorithm, then looping through the analysis until the calibration process is complete. Following this, the "tuning" of the guitar could be changed to any predetermined state using the calibration algorithm without further need of recalibration. Examples are the 12 standard "open" tunings, equal tempered tuning, just tuning in musical pitch, and varying the pitch of any of these tuning modes by four half steps up or down during the playing of a song.

String Adjustment

Each string may be wound around a machined shaft and connected to a stepper motor via a suitable gearbox. This will establish a relationship between the number of steps required to produce a given change in the frequency of a string. If the computer is allowed to "calibrate" before use, the details of how each motor transduces "steps" into "frequency change" can all be included in the computer algorithm. This reduces the dependence of the system performance on the machine steps to the point where the only requirement is reproducability.

The connection to the stepper motors is a very simple digital pulse interface common to most computers. When the system determines the correct number of steps for each motor, these steps are sent as transistor-transistor logic (TTL) level pulses over the digital lines to each motor using standard TTL techniques. The system may include means for first "loading" a pulse count into all motor controllers followed by a "go" command such that all motors move in unison.

Stepper Motors and Mechanical System

The mechanical details of the application of the current system to the tuning of a six string guitar will now be given. Table I gives the worst case values for the movement and tension of the six strings.

TABLE I

Worst Case Tensions and Motions of Strings at Bridge

| string | string motion[1] (in) | string tension[2] (lbs) |
|---|---|---|
| 1 | 0.110 | 20 |
| 2 | 0.063 | 25 |
| 3 | 0.035 | 38 |
| 4 | 0.059 | 36 |
| 5 | 0.047 | 33 |
| 6 | 0.035 | 28 |

string motion: 600 cents, 2 frets over to 4 frets under normal tuning
[1]steel strings: 0.009, 0.011, 0.016, 0.024, 0.036, 0.042 (in)
[2]phosphor bronze strings: 0.010, 0.014, 0.023, 0.030, 0.039, 0.047 (in)

The drawings show a mechanical configuration for the adjustment of string tension on the guitar. Each string is attached to a curved hard metal surface or string holder which rotates on a shaft that is concentric with the curved surface. The simplicity of the connection of the string to the system removes the need for a more complicated routing of the string, possibly over one or more pulleys. This configuration provides a minimum value for friction in this area where the forces are highest.

Connected to the string holder is a "lever" which provides the initial mechanical advantage in the system. If the radius of the string holder surface is "a" and the effective lever length is "b", the ideal mechanical advantage of the lever is b/a. Let the ratio b/a=10. Two useful relationships are thus determined:

force at end of lever=string tension/10 travel of end of lever=string motion * 10

The end of the lever is driven by a lead screw connected to a stepper motor. Let the following describe this configuration:

lead screw: 40 threads/in motor steps/revolution: 48 (Airpax #K82201-P2)

dynamic motor torque: 0.60 oz-in, $3.75\times10^{-2}$ lb-in (Airpax #K82201-P2)

holding motor torque: 1.4 oz-in, $8.75\times10^{-2}$ lb-in (Airpax #K82201-P2)

Then there are 192 steps/in on string motion at the bridge and, without friction, the dynamic force on the string at the bridge is 94.2 lbs., and the holding force on the string at the bridge is 287 lbs. Table II shows the resulting settability for each string.

TABLE II

Total Steps for Worst Case Motions
Precision of String Frequency Setting, and Times for 100 cents

| string | total steps | steps/cent | cents/ step | times for 100 cents at 200 step/sec (sec) | 600 steps/sec (sec) |
|---|---|---|---|---|---|
| 1 | 2112 | 3.52 | 0.284 | 1.76 | 0.59 |
| 2 | 1212 | 2.02 | 0.496 | 1.01 | 0.34 |
| 3 | 672 | 1.12 | 0.893 | 0.56 | 0.19 |
| 4 | 1134 | 1.89 | 0.530 | 0.95 | 0.32 |
| 5 | 1422 | 2.37 | 0.423 | 1.19 | 0.04 |
| 6 | 672 | 1.12 | 0.893 | 0.56 | 0.19 |

NOTE: 100 cents = ½ step

FIGS. 2 and 3 show the mechanical configuration of the string, lever, leadscrew, and stepper motor. The stepper motor is connected via suitable cable to the pulse output of digital computer/logic interface in standard fashion.

The "strummer", mentioned above, is connected to a similar computer interface and will excite the strings of the guitar on command from the computer.

Finally, the output from the guitar's amplifier is fed through a programmable filter to a standard analog to digital converter system in the computer. The analog to digital conversion frequency and the filter frequency are controlled by the computer in accordance with the Nyquist sampling theorum to prevent "aliasing" in the data. Generally, the conversion frequency must be faster than two times the maximum frequency of the signal of interest. Additionally, the filter corner frequency must be set to just above the maximum frequency of interest (10% is usually chosen to prevent filter generated phase problems near the edges of the resulting spectrum).

What is claimed is:

1. A system for automatically tuning a musical instrument having adjustment means for changing the frequency of a musical tone produced by said instrument; said system comprising:

(a) a detection means adapted to detect a musical tone produced by said instrument and produce a signal;

(b) converter means adapted to convert said signal to a digital signal;

(c) processing means adapted to convert said digital signal to a frequency signal;

(d) comparator means for comparing said frequency signal to a predetermined frequency value and producing an electrical signal;

(e) motor means activated by said electric signal; wherein said motor means is operably connected to said adjustment means for adjusting said frequency to correspond with said predetermined value;

wherein said instrument comprises a stringed instrument including a plurality of strings; wherein said adjustment means comprises a plurality of tensioning means corresponding to the number of said strings to be tuned, each said tensioning means being connected to one of said strings, wherein said motor means is operably connected to said tensioning means, and wherein all said strings to be tuned are tuned simultaneously.

2. A tuning system in accordance with claim 1, wherein said instrument is a guitar.

3. A tuning system in accordance with claim 1, wherein siad motor means comprises a stepper motor.

4. A tuning system in accordance with claim 1, wherein said detection means comprises a magnetic pickup.

5. A tuning system in accordance with claim 1, wherein said detection means comprises a transducer.

6. A tuning system in accordance with claim 1, wherein said processing means for converting said digital signal to a frequency signal includes the use of a fast Fourier transform.

7. A tuning system in accordance with claim 1, further comprising compensating means for compensating for non-linear effects of said instrument.

8. A tuning system for automatically tuning a musical instrument having a plurality of strings, said instrument comprising:

(a) detection means adapted to detect a musical tone produced by each said string and produce a signal corresponding to each said tone;

(b) converter means adpated to convert each said signal to a digital signal;

(c) processing means adpated to convert each said digital signal to a frequency signal;

(d) comparator means for comparing each said frequency signal to a separate predetermined frequency value and producing an electrical signal corresponding to the difference between said frequency signal and said predetermined frequency value;

(e) tensioning means operably connected to each of said strings to be tuned and being adapted to loosen or tighten said string;

(f) motor means operably connected to each said tensioning means and being adapted to control said tensioning means in response to said electrical signal; wherein each said motor means comprises a stepper motor; and wherein all said strings are tuned simultaneously.

9. A tuning system in accordance with claim 8, wherein said instrument is a guitar.

10. A tuning system in accordance with claim 8, wherein said detection means comprises a magnetic pickup.

11. A tuning system in accordance with claim 8, wherein said detection means comprises a transducer.

12. A tuning system in accordance with claim 8, wherein said processing means for converting said digital signal to a frequency signal includes the use of a fast Fourier transform.

13. A tuning system in accordance with claim 8, further comprising compensating means for compensating for non-linear effects of said instrument.

* * * * *